US007344229B2

(12) United States Patent
Ito et al.

(10) Patent No.: US 7,344,229 B2
(45) Date of Patent: Mar. 18, 2008

(54) INKJET RECORDING HEAD AND HEAD UNIT

(75) Inventors: Atsushi Ito, Nagoya (JP); Hiroki Kusakabe, Nagoya (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 346 days.

(21) Appl. No.: 11/122,184

(22) Filed: May 4, 2005

(65) Prior Publication Data

US 2005/0248627 A1 Nov. 10, 2005

(30) Foreign Application Priority Data

May 7, 2004 (JP) ..... P2004-138454

(51) Int. Cl.
*B41J 2/14* (2006.01)
*B41J 2/45* (2006.01)

(52) U.S. Cl. ..... 347/71; 347/41

(58) Field of Classification Search ..... 347/47, 347/20, 71

See application file for complete search history.

(56) References Cited

U.S. PATENT DOCUMENTS

| | | | | |
|---|---|---|---|---|
| 5,402,159 A | | 3/1995 | Takahashi et al. | |
| 5,721,573 A | * | 2/1998 | Benjamin | 347/7 |
| 6,053,597 A | | 4/2000 | Hirota | |
| 6,464,344 B2 | * | 10/2002 | Ikeda | 347/65 |
| 6,478,399 B1 | | 11/2002 | Mitsuzawa et al. | |
| 2003/0146742 A1 | * | 8/2003 | Nishida et al. | 324/76.11 |
| 2003/0218659 A1 | * | 11/2003 | Ito | 347/71 |

FOREIGN PATENT DOCUMENTS

| | | |
|---|---|---|
| EP | 0 389 296 | 9/1990 |
| EP | 0 775 587 | 5/1997 |
| JP | 4-341853 | 11/1992 |
| JP | 5-159112 | 6/1993 |
| JP | 08043271 | 9/1997 |
| JP | 09234861 | 9/1997 |
| JP | 9-314828 | 12/1997 |
| JP | 11-147316 | 6/1999 |
| JP | 2000-71440 | 3/2000 |

* cited by examiner

*Primary Examiner*—Stephen Meier
*Assistant Examiner*—Sarah Al-Hashimi
(74) *Attorney, Agent, or Firm*—Reed Smith LLP

(57) ABSTRACT

An inkjet recording head includes a plurality of plates bonded to each other and an information recording portion. The plates include a first plate defining in one surface thereof a plurality of nozzle holes through which ink is ejected to a recording medium. The one surface of the first plate is exposed to an outside. In the information recording portion, unique information of the inkjet recording head is recorded. The information recording portion is disposed so as to be readable from the outside on a one-surface side.

17 Claims, 10 Drawing Sheets

INKJET RECORDING HEAD AND HEAD UNIT

BACKGROUND OF THE INVENTION

1. Field of the Invention

The present invention relates to an inkjet recording head, which ejects ink onto a recording medium to record images, and a head unit.

2. Description of the Related Art

An inkjet recording head (hereinafter referred to as a recording head) is used to record an image on a paper (recording medium), in a printer serving as an output device of a computer, a copier, a facsimile, or the like. The recording head includes, for example, a member defining nozzles for ejecting ink and an actuator such as a piezoelectric element or a heating resistor in combination. The recording head ejects ink by actuating the actuator to record an image.

However, the recording head is an extremely minute device and also has a large deviation in individual characteristics. For this reason, it has been know that optimum activating voltage or the like is determined in advance by measuring the characteristics of respective recording heads and that each of the recording heads is controlled in response to the respective characteristics thereof when each recording head is installed in a main body of a recording device.

For example, JP-A-Hei.5-159112 and U.S. Pat. No. 6,053,597 disclose that a cartridge in which a recording head unit and an ink tank unit are integrated has a bar code label containing characteristic information attached on a side surface of the ink tank unit, and that control is performed in response to the characteristic information obtained by reading the bar code.

In addition, U.S. Pat. No. 6,478,399 discloses that a head unit provided with a detachable ink cartridge has a bar code label containing characteristic information attached on an upper surface of a casing thereof, and that control is performed in response to the characteristic information.

SUMMARY OF THE INVENTION

In JP-A-Hei.5-159112, U.S. Pat. No. 6,053,597 and U.S. Pat. No. 6,478,399, the label is pasted to the ink tank or casing after a finished recording head is mounted on the ink tank or casing. Accordingly, when the finished recording head is used, it is possible to make reference to the characteristic information of the entire recording head by identifying the recording head through the information recorded on the label.

However, the recording head has wide deviation caused during its manufacturing in the nozzle diameter or the actuator performance. As a result, combination of a member having the nozzles and the actuator has a significant effect on the characteristic of the entire recording head. For this reason, it is necessary that characteristics of each component should be inspected for quality management even during a process of manufacturing the recording head.

Also, as disclosed in JP-A-Hei.5-159112, U.S. Pat. No. 6,053,597 and U.S. Pat. No. 6,478,399, a problem has arisen in that it takes time to paste the label to the recording head.

Further, a problem has arisen in that it is not possible to make reference to the characteristic information when the label is removed or contaminated.

The invention provides an inkjet recording head and a head unit capable of being formed therein unique information of the recording head easily, allowing an operator to make reference to the unique information easily when the recording head is replaced with anew one or mounted onto a main body of a recording device, and preventing the unique information from being illegible.

According to one embodiment of the invention, an inkjet recording head includes a plurality of plates bonded to each other and an information recording portion. The plates include a first plate defining in one surface thereof a plurality of nozzle holes through which ink is ejected to a recording medium. The one surface of the first plate is exposed to an outside. In the information recording portion, unique information of the inkjet recording head is recorded. The information recording portion is disposed so as to be readable from the outside on a one-surface side.

According to this structure, the information recording portion is disposed to be readable from the outside on the one-surface side. Also, the recording head itself has the unique information recorded therein. Accordingly, it is possible to store measurement data obtained during manufacturing the recording head so as to be associated with the unique information and utilize the measurement data for quality management and/or understanding of manufacturing history.

According to one embodiment of the invention, a head unit includes an inkjet recording head, and a head holder. The inkjet recording head includes a plurality of plates bonded to each other. The plates include a first plate defining in one surface thereof a plurality of nozzle holes through which ink is ejected to a recording medium. The one surface of the first plate is exposed to an outside. The inkjet recording head is mounted on the head holder so that the one surface of the first plate faces the recording medium. The head holder is capable of moving in parallel to the recording medium. The inkjet recording head includes an information recording portion in which unique information of the inkjet recording head is recorded. The information recording portion is disposed so as to be readable from the outside on a one-surface side.

According to this structure, in the head unit including the inkjet recording head and the head holder onto which the recording head is mounted, the head holder capable of scanning in parallel to the recording medium, the information recording portion is disposed so as to be readable from the outside on the one-surface side. Also, the recording head itself has the unique information recorded therein. Accordingly, it is possible to store measurement data obtained during manufacturing the recording head so as to be associated with the unique information and utilize the measurement data for quality management and/or understanding of manufacturing history.

DETAILED DESCRIPTION OF THE PREFERRED EMBODIMENTS

Hereinafter, embodiments of the invention will be described with reference to the accompanying drawings.

Figure 1:
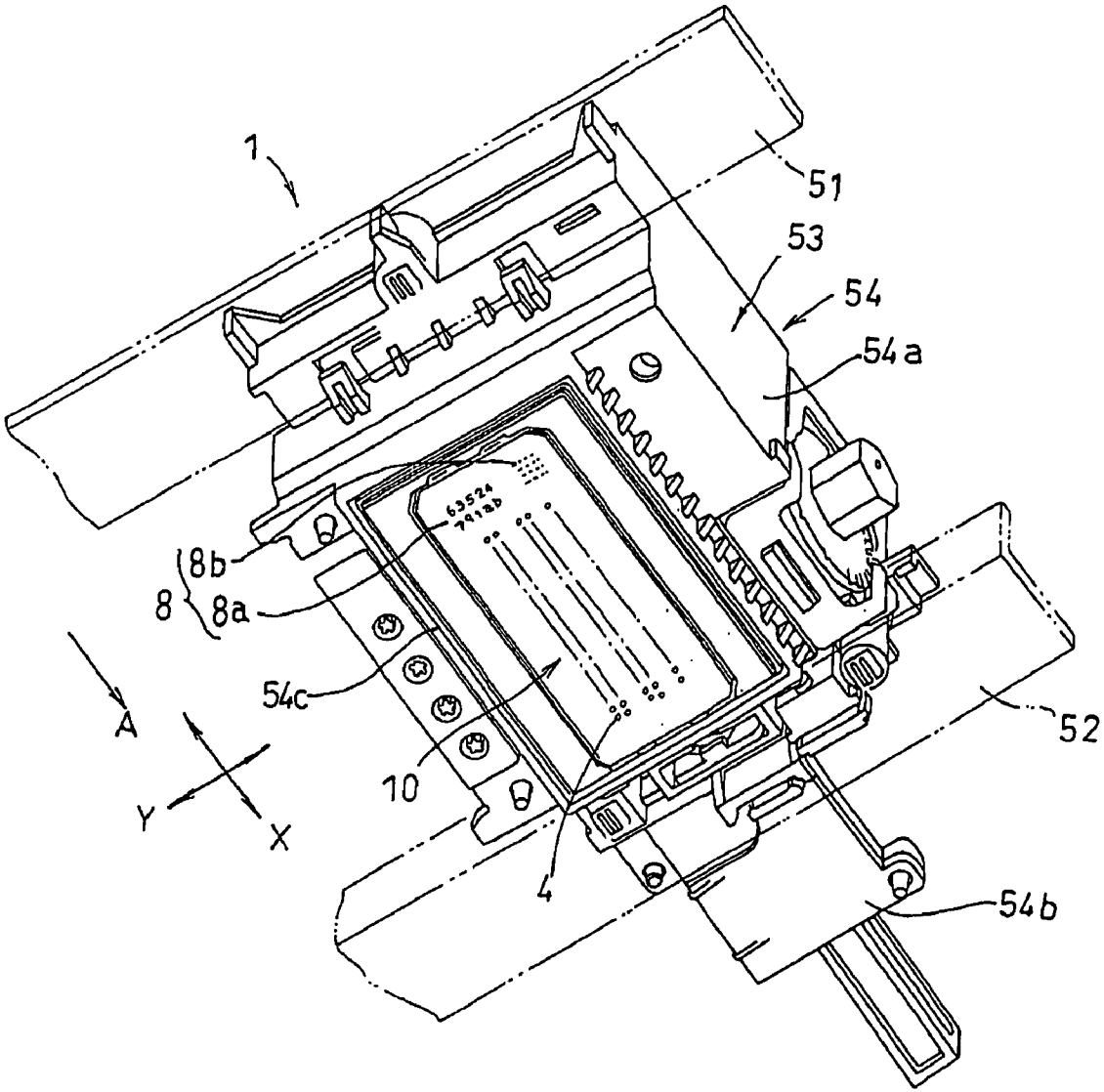
FIG. 1 is a perspective view illustrating a recording portion of an inkjet printer according to a first embodiment as viewed from a bottom surface (i.e., a nozzle surface) side of the recording portion.

As shown in FIG. 1, the inkjet printer according to this embodiment includes a recording unit 1, which is provided into a main frame (not shown), for ejecting ink onto a printing paper as a recording medium to record images. The inkjet printer serves as a printer of a multi-function device (MFD) having, for example, function as a copier, scanner, facsimile, etc.

The recording unit 1 includes a head unit 53 constituting a carriage slidably reciprocating on horizontal plate-shaped guide rails 51 and 52 extending in a Y-direction (a direction perpendicular to a paper conveyance direction, i.e. X-direction, that is, a main scanning direction).

As shown in FIG. 1, the head unit 53 includes a head holder 54, an inkjet recording head (hereinafter referred to as a recording head) and a damper device 55 (see FIG. 6). The head holder 54 has a substantially box-shaped main-body portion 54*a* and a connecting support piece 54*b* protruding toward downstream of the paper conveyance direction (a direction indicated by arrow A in FIG. 1) from the main-body portion 54*a*. The inkjet recording head 10 is fixed to face a paper, at a lower surface side of a bottom plate 54*c* of the head holder 54. The damper device 55 is fixed to an upper side of the bottom plate 54*c*.

The inkjet printer has individual ink tanks (not shown), which are provided in a main frame of a main body, including tanks for yellow ink (Y), magenta ink (M), cyan ink (C), and black ink (Bk) serving as ink supply sources for full-color recording. The ink is supplied from individual ink tanks to the recording head 10 through individual ink supply pipes (not shown) such as ink tubes and the damper device 55.

Figure 2:
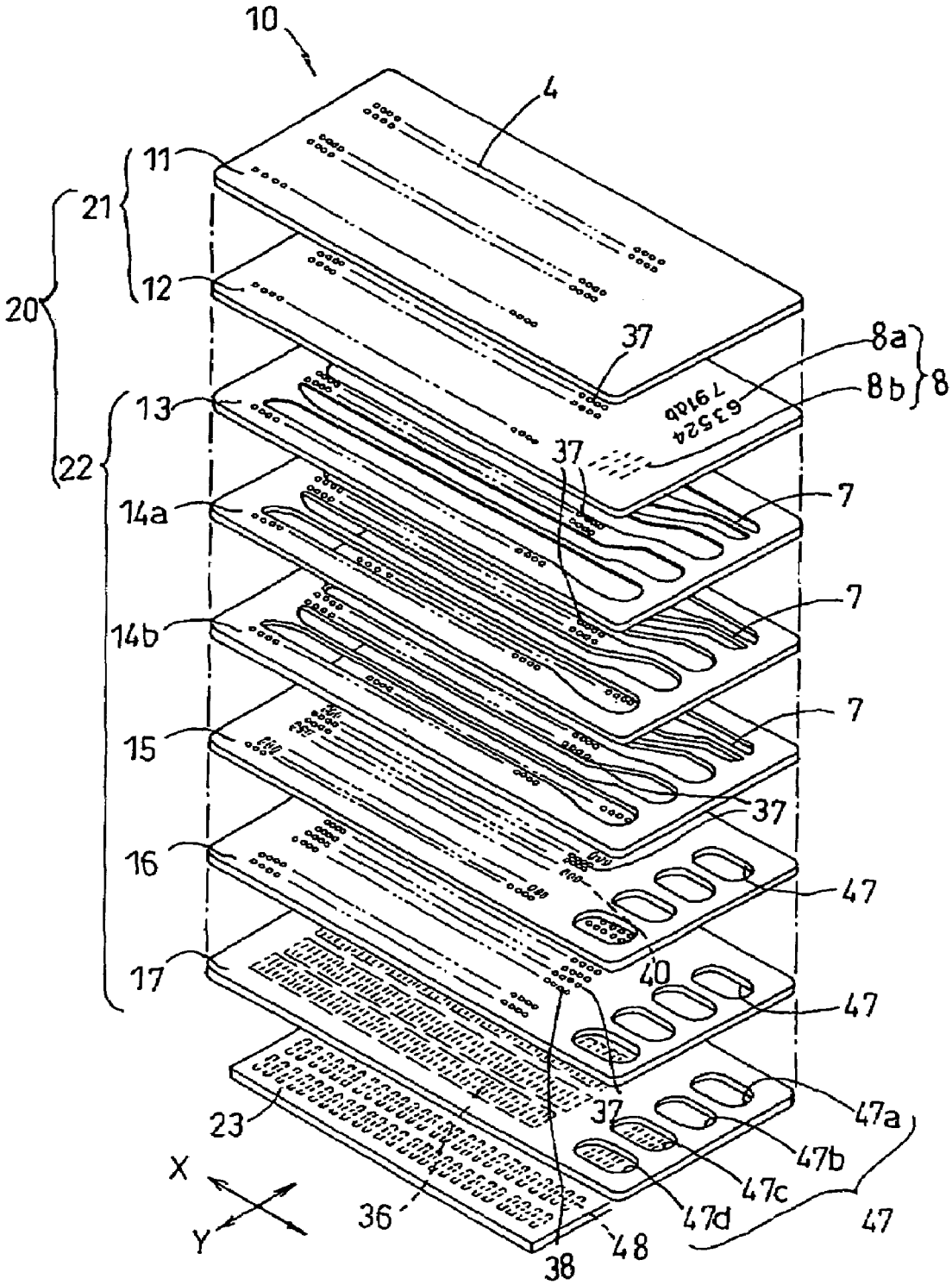
FIG. 2 is an exploded perspective view illustrating a cavity unit.
Figure 4:
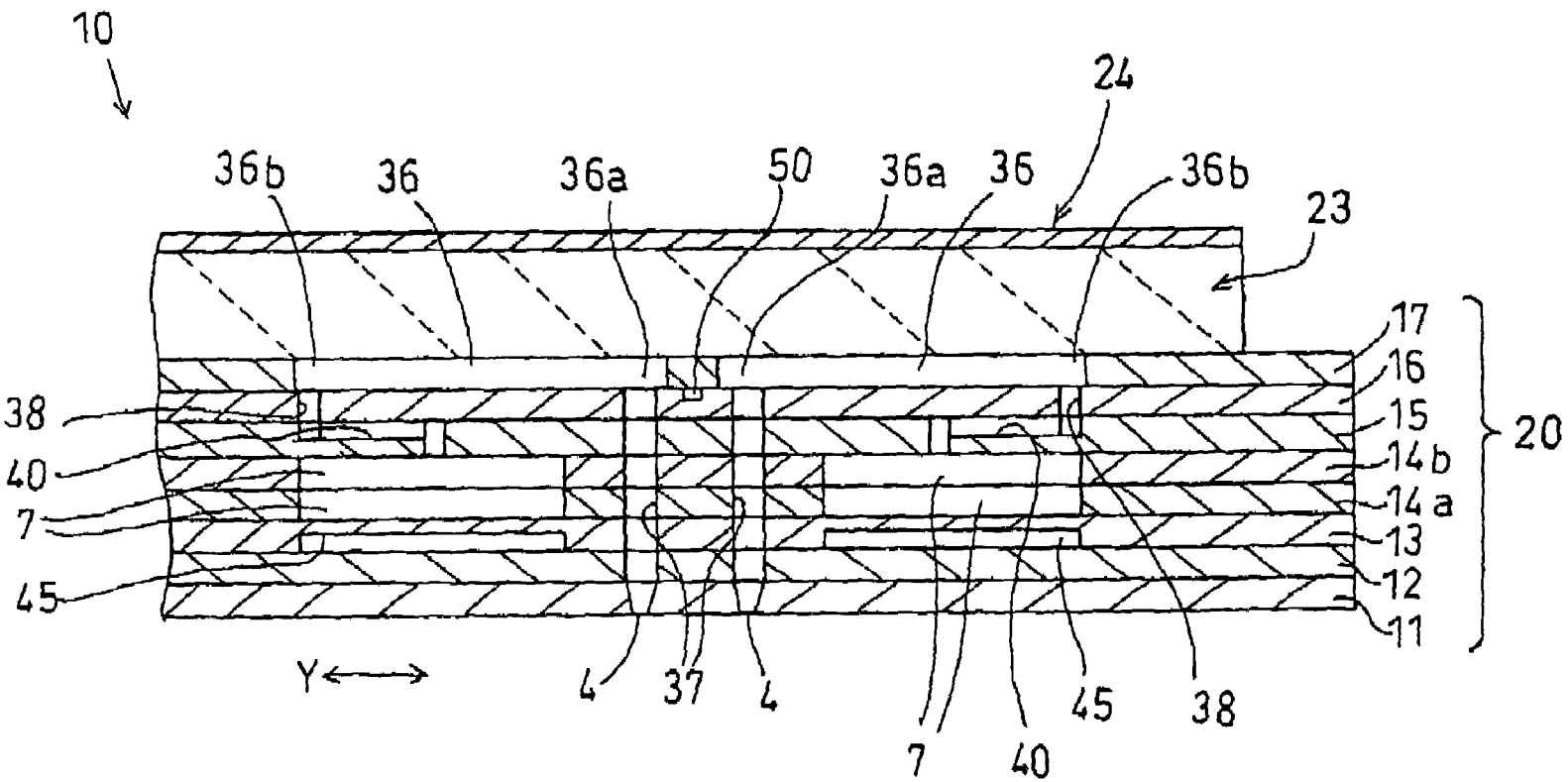
FIG. 4 is a partially enlarged sectional view illustrating the cavity unit.

As shown in FIGS. 2 and 4, the recording head 10 includes a cavity unit 20 having a plurality of nozzle holes 4, which are arranged on a surface (front surface) exposed to outside, for ejecting the ink onto a printing paper; a plate-shaped piezoelectric actuator unit 23 laminated and fixed on a rear side of the cavity unit 20; and a flexible flat cable 24 laminated and fixed on a rear side of the piezoelectric actuator unit 23 for connection with external devices. Since FIG. 2 is a diagram illustrating the recording head 10 as viewed from the nozzle surface (front surface) side, the piezo electric actuator unit 23 is disposed on a lower side of the cavity unit 20 while the nozzle surface is positioned on an upper side. However, the nozzle surface is placed on a lower side when the recording head 10 is actually mounted on the inkjet printer.

As shown in FIG. 2, the cavity unit 20 has a laminated structure including a total of eight plates, that is, a nozzle plate 11, a spacer plate 12, a damper plate 13, two manifold plates 14*a* and 14*b*, a supply plate 15, a base plate 16, and a cavity plate 17, laminated and joined on each other with adhesive agent.

In this embodiment, each of the plates 11 to 17 has a thickness of about 50 to 150 μm. The nozzle plate 11 is made of a substantially transparent synthetic resin such as polyimide, while the other plates 12 to 17 are made of a substantially opaque material such as metal (e.g., a nickel alloy steel including 42% of nickel) or a silicone. In the nozzle plate 11, the nozzles holes 4 for ejecting ink are defined to have an extremely small diameter (about 25 μm in this embodiment) and to be arranged at predetermined minute intervals. The nozzle holes 4 are arranged along a long-side direction (X direction) of the nozzle plate to form five rows in a zigzag manner.

Figure 3:
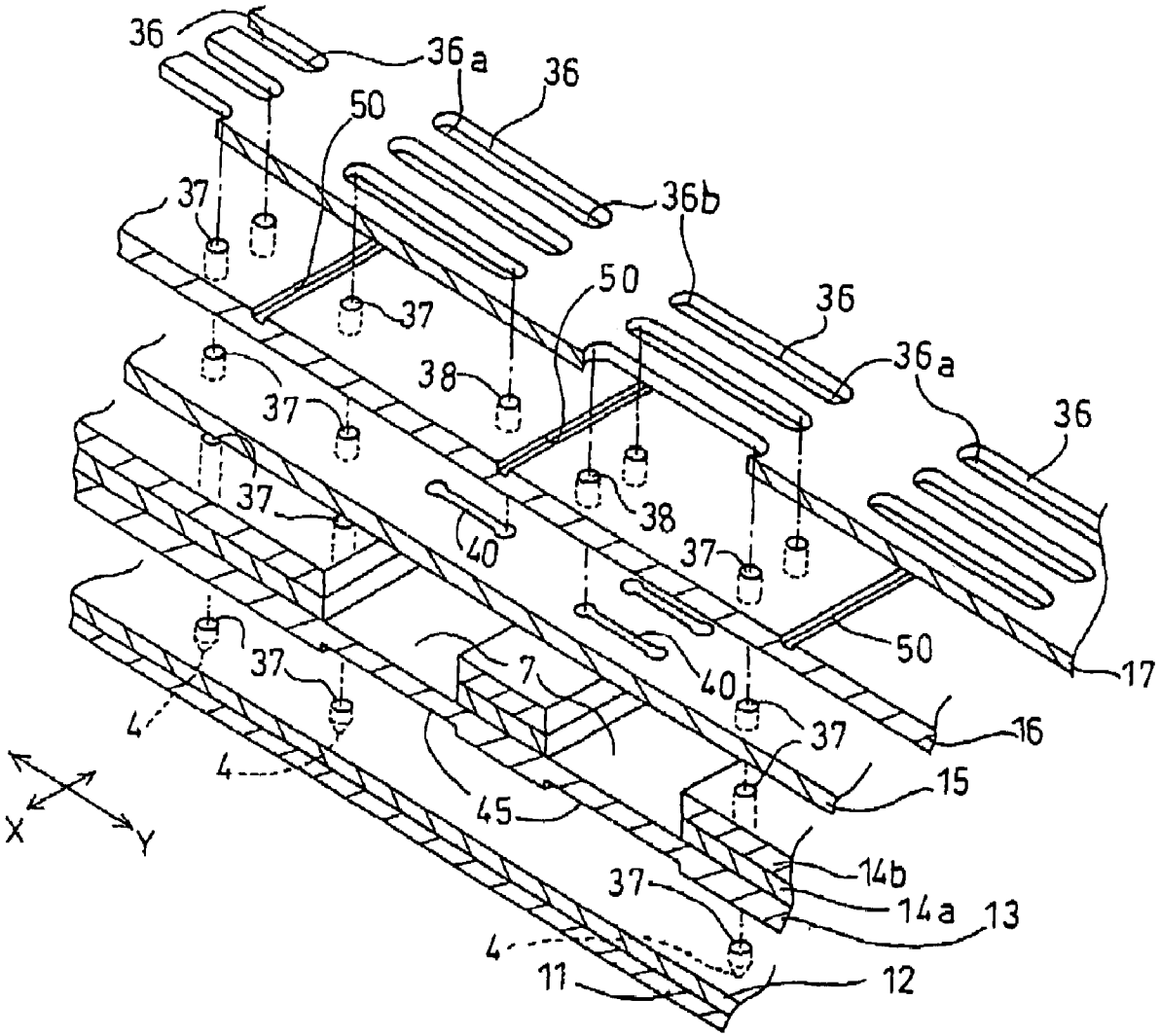
FIG. 3 is a partially exploded perspective view illustrating the cavity unit.

Also, as shown in FIG. 3, in the cavity plate 17, a plurality of pressure chambers 36 are arranged along a long-side direction (the X direction) of the cavity plate to form five rows in a zigzag manner. In this embodiment, each of the pressure chambers 36 is formed in an elongated rectangle shape as viewed in a plan view. The pressure chambers 36 passes through the cavity plate 17 so that its longitudinal direction extends in a short-side direction (Y direction) of the cavity plate 17. Also, one end portions 36*a* thereof in the longitudinal direction communicate with the nozzle holes, and the other end portions 36*b* communicate with common ink chamber 7, which will be described later.

The end portions 36*a* of the pressure chambers 36 communicate with the respective nozzle holes 4 of the nozzle plate 11 through communication holes 37, which have a minute diameter and are formed in a similar zigzag manner to pass through the supply plate 15, the base plate 16, the two manifold plates 14*a* and 14*b*, the damper plate 13, and the spacer plate 12.

The base plate 16 adjacent to a lower surface of the cavity plate 17 defines through-holes 38 at a position corresponding to the other end portions 36*b* of the respective pressure chambers 36, in order to connect to the other end portions 36*b*.

The supply plate 15 adjacent to a lower surface of the base plate 16 defines connection flow path 40 for supplying the ink from the common ink chamber 7 to the respective pressure chambers 36. Each of the connection flow path 40 has an inlet hole to which the ink is introduced from the common ink chamber 7, an outlet hole opened to the pressure chamber 36 (the through-holes 38), and a flow restricting portion between the inlet and outlet holes. The flow restricting portion has a small sectional area to have the largest flow resistance of the ink in the connection flow path.

The two manifold plates 14*a* and 14*b* are have five long common ink chambers 7 along the long-side direction (X-direction) thereof. The common ink chambers are formed to pass through the entire thickness of each of the two manifold plates 14*a* and 14*b* and to extend along the respective rows of the nozzle holes 4. That is, as shown in FIGS. 2 and 4, the five common ink chambers (manifold chambers) 7 are formed hermetically by laminating the two manifold plates 14*a* and 14*b* on each other, covering an upper surface thereof (a lower surface in FIG. 2) with the supply plate 15, and covering a lower surface thereof (an upper surface in FIG. 2) with the damper plate 13. Each common ink chamber 7 elongates in a direction substantially parallel to the rows of the pressure chambers 36 (the direction of the rows of the nozzle holes 4) while partially overlapping the pressure chambers 36, as viewed in a direction perpendicular to the laminated direction of each plate.

As shown in FIGS. 3 and 4, the damper plate 13 adjacent to a lower surface of the manifold plate 14*a* defines damper chambers 45 recessed on a lower surface thereof so that the damper chambers 45 are isolated from the common ink chamber 7. As shown in FIG. 2, the position and shape of respective damper chambers 45 are identical with those of respective common ink chambers 7. Since the damper plate 13 is made of elastically deformable metal, a sheet-shaped ceiling portion on an upper side of the damper chamber 45 can freely oscillate toward the common ink chamber 7 and toward the damper chamber 45. Even though pressure variation generated in the pressure chamber 36 upon ejecting ink is transmitted to the common ink chamber 7, the pressure variation can be damped or absorbed by an elastic deformation of the ceiling portion, thereby being prevented from crosstalk transmitting the pressure variation to other pressure chambers 36.

In addition, as shown in FIG. 2, each of the cavity plate 17, the base plate 16, and the supply plate 15 defines four ink supply ports 47 is formed to pass therethrough at an end portion on one short-side side so that positions of the ink supply ports 47 correspond to each other vertically. Outlet openings of the damper device 55 communicate with one end portions of the respective common ink chambers 7 through the ink supply ports 47. The four ink supply ports 47 are denoted by 47*a*, 47*b*, 47*c*, and 47*d* from the right side of FIG. 2, respectively.

In ink flow paths from the ink supply ports 47 to the nozzle holes 4, after ink supplied from the damper device 55 is supplied from the ink supply ports 47 to the common ink chambers 7 serving as ink supply channels, the ink is distributed to the respective pressure chambers 36 via the connection flow paths 40 of the supply plate 15 and the through-holes 38 of the base plate 16 as shown in FIG. 3. As described later, then, the ink is supplied from inside of each of the pressure chambers 36 to the nozzle hole 4 corresponding to the pressure chamber 36 via the corresponding communicating holes 37, by activation of the piezoelectric actuator unit 2.

In this embodiment, as shown in FIG. 2, the four ink supply ports 47 are defined, while the five common ink chambers 7 are defined. Here, only the ink supply port 47*a* for supplying black ink is connected to two common ink chambers 7 and 7. The black ink is supplied to the ink supply port 47*a*. This is because the black ink is more frequently used than the other color inks. Yellow, magenta, and cyan inks are supplied to the other ink supply ports 47*b*, 47*c*, 47*d*, respectively.

Also, the base plate 16 defines circulation grooves 50 for testing, which are opened to a boundary face with the cavity plate 17 while being opened toward a end face on a short-side side of the base plate 16. During the manufacturing process, a leak test is performed using the circulation grooves 50 for testing to inspect poor sealing between the pressure chambers 36 due to poor adhesion between the cavity plate 17 and the base plate 16.

Figure 5:
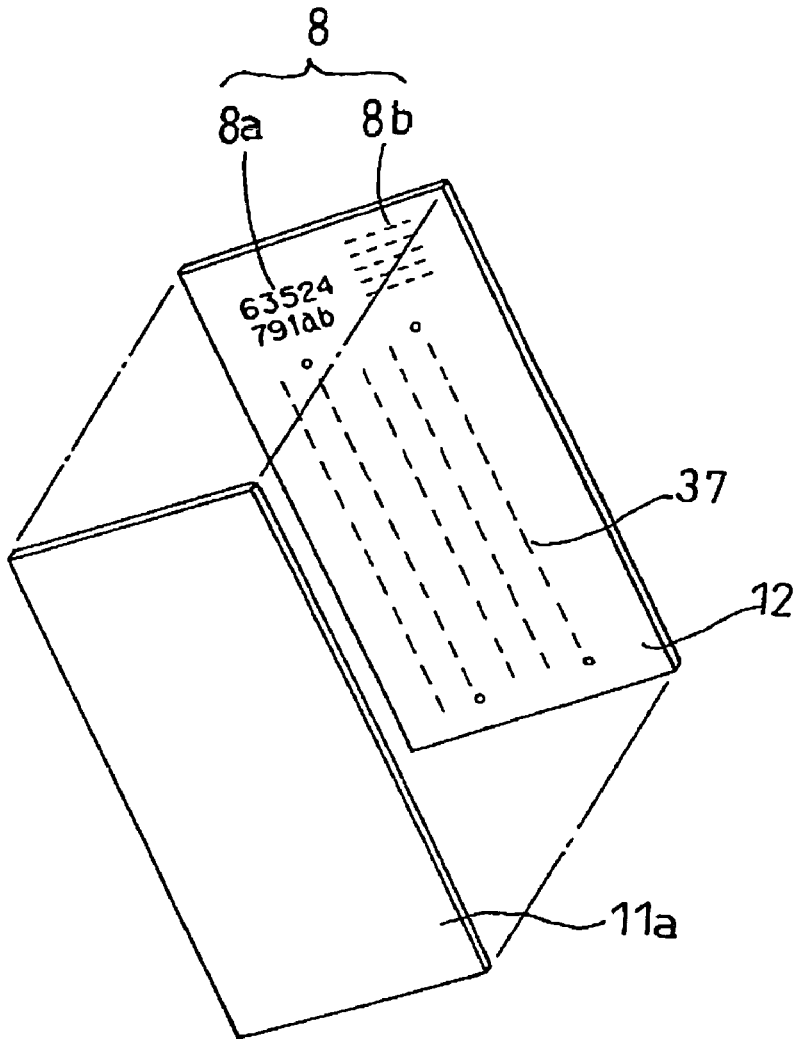
FIG. 5 is a diagram illustrating formation of a first subunit of the cavity unit.

Also, the cavity unit 20 has an information recording portion 8, in which in which unique information of the recording head 10 is recorded, so that the information recording portion 8 is readable from outside on the nozzle plate 11 side. In this embodiment, the information recording portion 8 is disposed on a surface of the spacer plate 12, which faces the nozzle plate 11. As shown in FIGS. 2 and 5, the nozzle plate 11 is adhered to the spacer plate 12 to cover the information recording portion 8.

The information recording portion 8 is disposed outside a region where the plural communicating holes 37 form the rows in the spacer plate 12, and is disposed at a position corresponding to a position of the ink supply ports 47. In other words, the information recording portion 8 at least partially overlaps the ink supply ports 47 when viewed in a plan view. The ink supply ports 47 are disposed outside a region corresponding to the rows formed of the nozzle holes 4 (communicating holes 37). Accordingly, the ink supply ports 47 occupy relatively wide region on an end portion on one short-side side of the cavity unit 20. Also, a hole process is not applied to the spacer plate 12 at a position corresponding to the inky supply ports 47. Accordingly, since the information recording portion 8 is disposed at the position described above, a wide are can be secured for the information recording portion 8.

In the information recording portion 8, a first code portion 8*a* and a second code portion 8*b* are provided. In the first code portion 8*a*, for example, a QR code or another two-dimensional code is recorded. The first code portion 8*a* is read by a known two-dimensional code scanner. The second code portion 8*b* is provided supplementarily so that when it is impossible to read the first code portion 8*a*, an operator can read from the second code portion 8*b* the same contents as the first code portion 8*a* with eyes. Since the two-dimensional code is adopted in the information recording portion 8, more information can be recorded in a small area. Here, the information recording portion 8 has a manufacturing serial number recorded thereon serving as unique information of the recording head 10. Measurement data and various data in each process in manufacturing the recording head 10 are stored in an external device (which will be described below) so as to be associated with the serial number. In addition, the first code portion 8*a* may contain more information as well as the serial number. Further, the second code portion 8*b* may be omitted. Also, the first code portion 8*a* is not limited to the two-dimensional code, but may be a bar code or hologram.

Also, the information recorded in the information recording portion 8 is formed as concavity and convexity. Here, the information is inscribed on the plate using a laser marker, etc. As described above, since the nozzle plate 11 is made of the substantially transparent material, the information recording portion 8 covered with the nozzle plate 11 is readable from the outside. Since the spacer plate 12 having the information recording portion 8 is covered with the substantially transparent nozzle plate 11, the information recording portion 8 is readable while the nozzle plate 11 protects the information recording portion 8 from contamination.

On the other hand, like a piezoelectric actuator unit disclosed in JP-A-Hei.4-341853, the piezoelectric actuator unit 23 has a structure in which a plurality of piezoelectric sheets are laminated on each other (not shown). Individual electrodes having a narrow width are formed on an upper surface (i.e., surface having a relatively large width) of each even-numbered one of the piezoelectric sheets, which have thickness of about 30 μm, as counted from the lowermost one. The individual electrodes are formed at positions corresponding to the pressure chambers 36, respectively. The individual electrodes extend in the long-side direction (X direction) to form rows. A common electrode, which is common to the plurality of pressure chambers 36, is formed on an upper surface (i.e., surface having a relatively large width) of each odd-numbered one of the piezoelectric sheets as counted from the lowermost one. On an upper surface of the top sheet, surface electrodes electrically connected to the individual electrodes and a surface electrode electrically connected to the common electrodes are formed as a surface electrode 48.

An adhesive agent sheet (not-shown) made of a synthetic resin material having ink nonpermeability is attached onto the entire lower surface of the sheet-shaped piezo electric actuator unit 23 (i.e., the wide width surface opposed to the pressure chambers 36) in advance. Then, the actuator unit 23 is bonded and fixed to the cavity unit 20 so that the individual electrodes are located at positions corresponding to the pressure chambers 36 of the cavity unit 20. Further, the flexible flat cable 24 (see FIG. 4) is laid and pressed onto the upper surface of the actuator unit 23. Thereby, electrically conductive wire patterns (not shown) of the flexible flat cable 24 are electrically connected to the surface electrodes 48, respectively.

Figure 7:
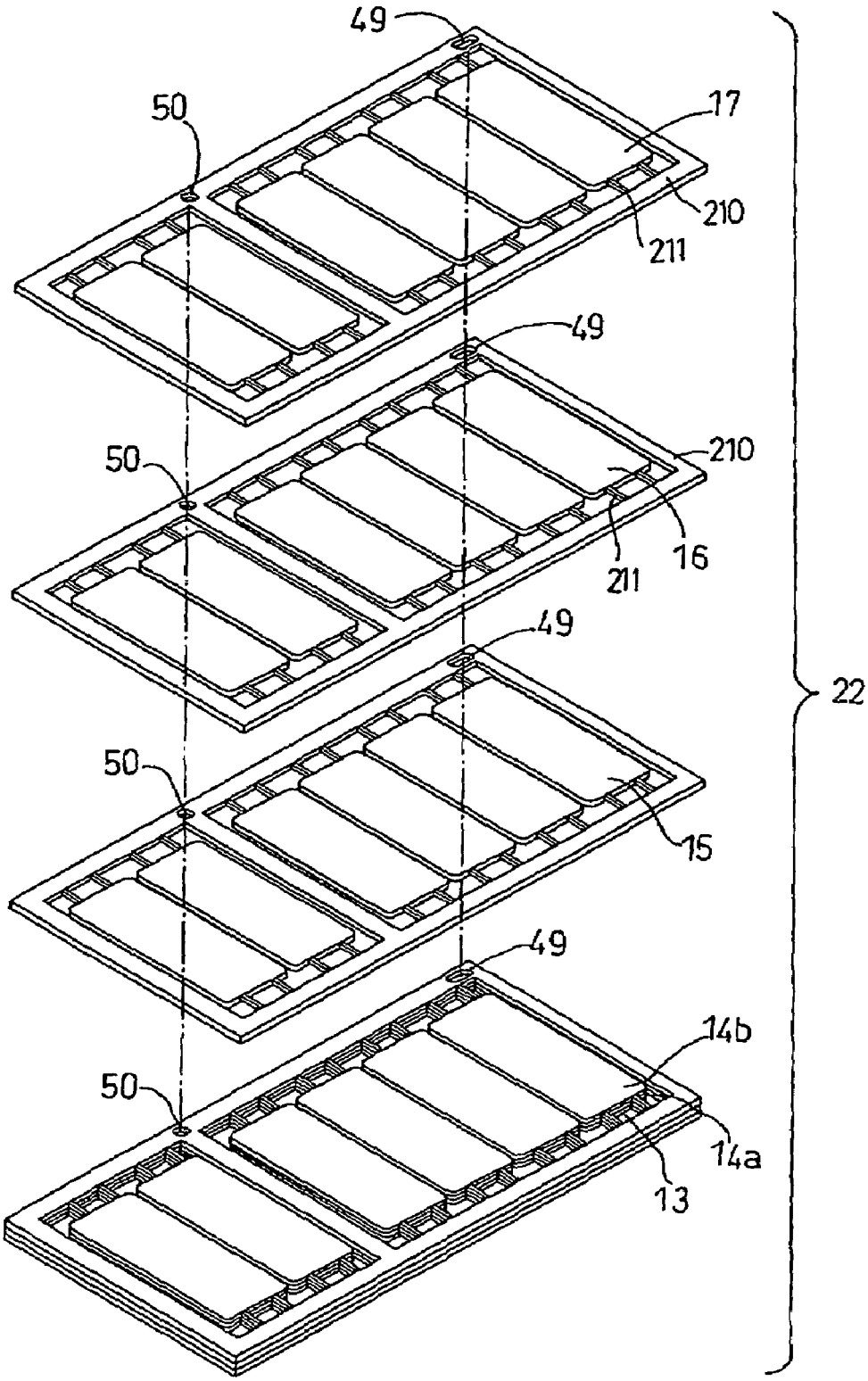
FIG. 7 is a diagram illustrating formation of a second subunit of the cavity unit.

In the first embodiment thus configured, as shown in FIG. 7, plural plates of the same type are connected to each other in plan view. More specifically, plural plates of each type are arranged in a frame 210 through connecting pieces 211 having a narrow width. Openings such as the pressure chamber and the communicating hole are formed in each plate by press machining, etching, or laser machining. At this time, the two-dimensional code (the first code portion 8*a*) and the second code portion 8*b*, which serve as the information recording portion 8, are inscribed by the laser machining in a surface of the spacer plate 12 facing the nozzle plate 11. Since plural spacer plates 12 are arranged in the frame 210, it is easy to attach a serial number serving as the information recording portion 8.

As shown in FIG. 5, a transparent plate material 11*a* serving as the nozzle plate 11 is adhered and fixed to each of the spacer plates 12 arranged in the frame 210 to cover the information recording portion 8. Thereafter, like a known method disclosed in JP-A-Hei.11-147316, a laser beam is irradiated to the spacer plate 12 and the nozzle plate 11, which are laminated on each other, through the communicating holes 37 from the spacer plate 12 side, thereby to forming the plural nozzle holes in the nozzle plate.

Also, a subunit 22 (see FIG. 2) is formed by laminating the damper plate 13, the manifold plates 14*a* and 14*b*, the supply plate 15, the base plate 16, and the cavity plate 17, which are arranged in the frames 210, respectively, and bonding and integrating those plates. The subunit 22 is laminated on a subunit 21 (see FIG. 2) in which the spacer plate and the nozzle plate have been integrated, and those subunits are bonded and are integrated together, thereby forming the cavity unit 20. The bonding is performed utilizing positioning holes 49 and 50 in the frame 210 shown in FIG. 7. After the bonding, the connecting pieces 211 are cut off to separate individual cavity units from each other.

At a time where the cavity unit 20 has been formed, machining accuracies such as diameters of the nozzle holes 4 or a hole pitch flow path resistance, are measured. Criterion for classifying the machining accuracies into plural levels (ranks) in accordance with finishing state of the cavity unit 20 is determined in advance. The measurement values and/or classified result of each cavity unit 20 are input into an external computer and stored in its storage device in association with the serial number recorded on the information recording portion 8.

Next, the cavity unit 20 is bonded with the piezoelectric actuator unit 23. The piezoelectric actuator unit 23 has also been assigned a lot number in advance, and been inspected to check piezoelectric characteristic thereof and classified into the levels (ranks). Further, an optimum combination for ejecting ink between classifications of the measurement values of the piezoelectric actuator units 23 and classifications of the measurement values of the cavity units 20 is determined in advance, and an optimum activating voltage for each combination is also determined in advance. Accordingly, upon bonding, a cavity unit 20 suitable for each piezoelectric actuator unit 23 can be selected on the basis of the unique information (serial number) recorded in the information recording section 8 thereof with reference to data.

Also, the machining accuracies of the nozzle holes 4 are inspected with using the cavity unit 20 along prior to bonding the cavity unit 20 and the piezoelectric actuator unit 23 together. Therefore, it is possible to remove only a defective cavity unit 20 without wasting a good piezoelectric actuator unit 23 if the nozzle hole formation has been made poorly.

The flexible flat cable 24 is further bonded to the cavity unit 20 and the piezoelectric actuator unit 23 to form the recording head 10. As described above, since the optimum activating voltage for the recording head 10 varies depending on the combination of the cavity unit 20 and the piezoelectric actuator unit 23, the activating voltage of each recording head 10 is stored in the external storage device so as to be associated with the unique information of the information recording portion 8. When the recording head 10 is mounted onto a main body of an inkjet printer, the activating voltage stored in the storage device is referred to on the basis on the unique information, and the voltage is set to an output voltage of the main body of the inkjet printer.

Also, when the recording head 10 is separated from a frame of the main body to be replaced with new one, an optimum activating voltage for the new recording head 10 can be identified based on the unique information recorded in the information recording portion 8. Therefore, an output voltage to the recording head 10 can be immediately changed.

In the first embodiment, the information recording portion 8 is disposed on the spacer plate 12 used for forming the nozzle holes 4, and the unique information for identifying the respective recording heads is attached in an early stage of the manufacturing process of the recording head 10. Therefore, it is possible to always collect and store data so as to be associated with the unique information. Accordingly, the unique information can be utilized in the manufacturing process for quality management such as removal of defective products or combination of optimum parts.

Figure 6:
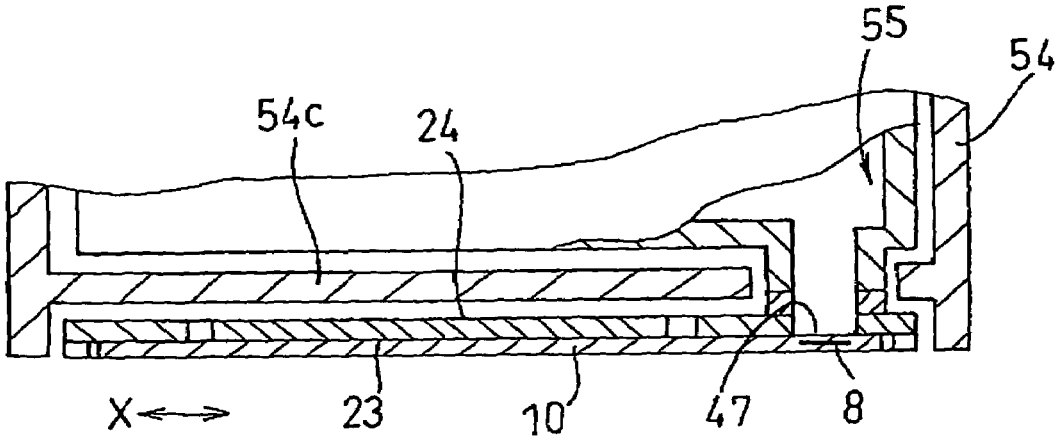
FIG. 6 is a partially sectional view illustrating a recording head.

Also, as shown in FIG. 6, the recording head 10 includes various elements such as a bottom plate 54*c* of the head holder and a damper device 55, on an opposite surface to a surface from which the nozzle hole 4 is exposed. Accordingly, since the information recording portion 8 is arranged to be readable from outside of the surface from which the nozzle hole 4 is exposed, the information recording portion 8 can be easily read without being obstructed by another element.

Also, since the information recording portion 8 is arranged at a position covered with the nozzle plate 11, even if the nozzle plate 11 is contaminated with ejected ink or particles of paper, those ink and particles are easily removed with using a known wiper member. Also, although the information recording portion 8 is implemented by minute concavity and convexity, those ink or particles of paper will not be retained in the information recording portion 8 to contaminate a recording medium.

Also, when the recording head 10 is broken down, it is possible to easily find out its manufacturing history based on the unique information of the information recording portion 8.

In addition, since the information recording portion 8 is directly inscribed on the plate, the information recording portion 8 can be formed even in a minute element such as the recording head 10. Accordingly, workability is more excellent than the conventional operation of pasting a label.

Next, a second embodiment of the invention will be described with reference to the drawings. The same as the elements of the first embodiment are denoted by the same reference numerals and detailed description thereof will be omitted herein.

While the ink is supplied from the ink supply source provided in a main body to the recording head 10 provided on a carriage (head unit 53) through an ink supply pipe in the first embodiment, the recording head 10 and an ink cartridge 61 serving as an ink supply source are mounted on a carriage 64 in the second embodiment.

Figure 8:
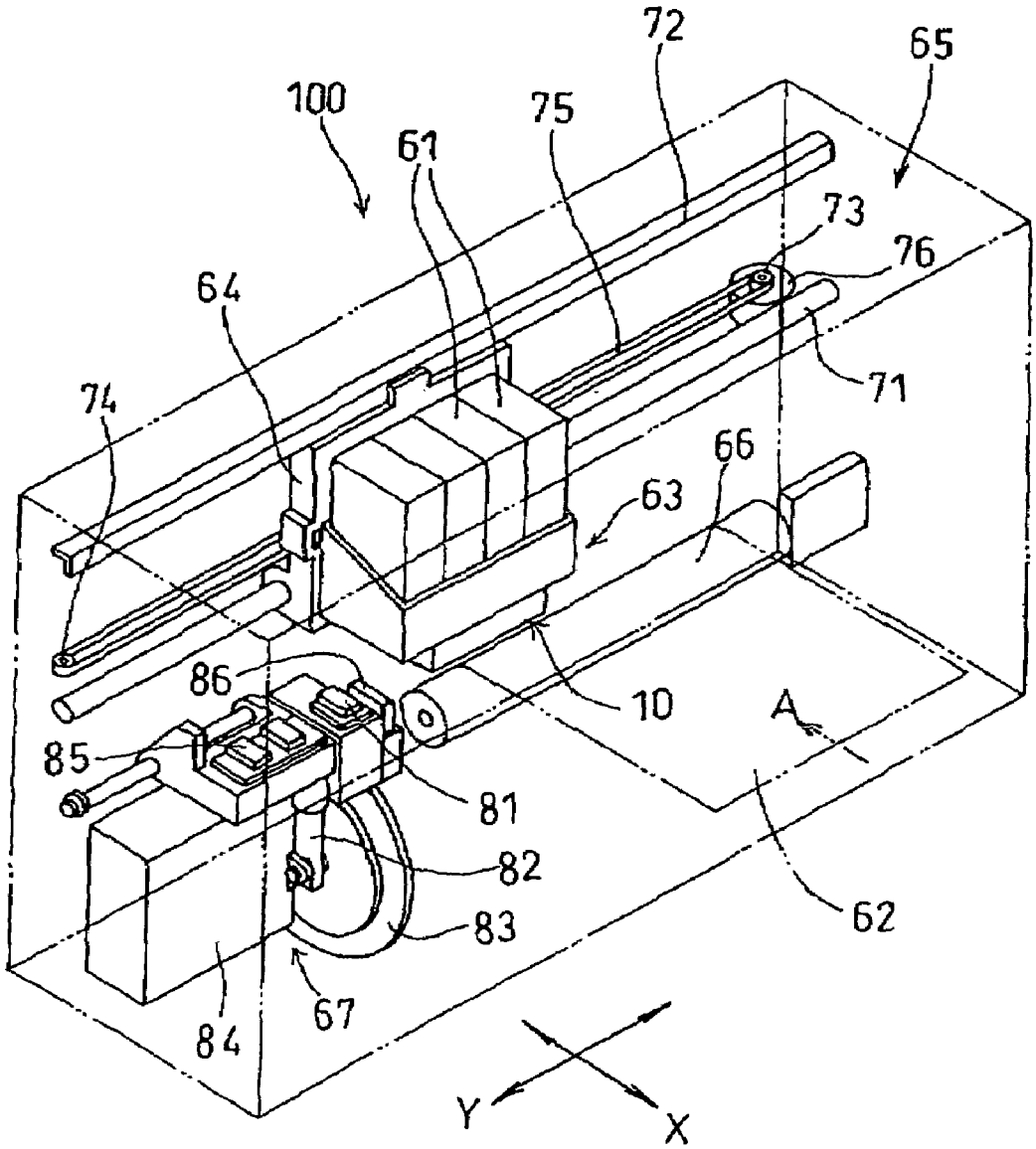
FIG. 8 is a perspective view illustrating an inkjet printer according to a second embodiment.

As shown in FIG. 8, an inkjet printer 100 according to the second embodiment includes the ink cartridge 61 filled with four color inks, for example, including cyan, magenta, yellow, and black; a head unit 63 for printing an image on a paper 62 (recording medium) 62; the carriage 64 on which the ink cartridge 61 and the head unit 63 are mounted; a driving unit 65 for reciprocating the carriage 64 in a direction (main-scanning direction, y-direction) perpendicular to a conveyance direction (sub-scanning direction, x-direction) of the paper 62; a platen roller 66 extending in the reciprocating direction of the carriage 64 and being arranged to face the head unit 63; and a purge unit 67.

The driving unit 65 includes a carriage shaft 71, which is disposed on a lower side of the carriage 64 and extends in parallel to the platen roller 66; a guide plate 72, which is disposed on an upper side of the carriage 64 and extends in parallel to the carriage shaft 71; two pulleys 73 and 74, which are disposed between the carriage shaft 71 and the guide plate 72 and arranged on both end portions of the carriage shaft 71; and a timing belt 75, which is wound around the two pulleys 73 and 74. The carriage 64, which is joined with the timing belt 75, can reciprocate linearly while being supported by the carriage shaft 71 and the guide plate 72, by a driving force transmitted from one pulley 73 rotated by a motor 76. The paper 62 conveyed in the X-direction (sub-scanning direction) from a paper feeder (not shown) is introduced into a gap between the platen roller 66 and the head unit 63. Subsequently, the ink is ejected from the head unit 63 onto the paper 62, thereby printing an image on the paper 62.

The purge unit 67 is disposed to face the head unit 63 when the head unit 63 is located at a recovery position. The purge unit 67 includes a purge cap 81, which abuts against the plural nozzle holes 4 of the head unit 63 to cover the nozzle holes 4; a pump 82; a cam 83; and an ink reservoir unit 84. When the head unit 63 is located at the recovery position, defective ink containing bubbles or the like within the head unit 63 is absorbed by the pump 82 by driving the cam 83, and is collected in the ink reservoir unit 84. Also, the purge unit 67 further includes a wiper member 86 for cleaning a nozzle surface of the head unit 63, and a cap 85 for covering the nozzle holes 4 when the carriage 64 returns to a rest position.

Figure 9:
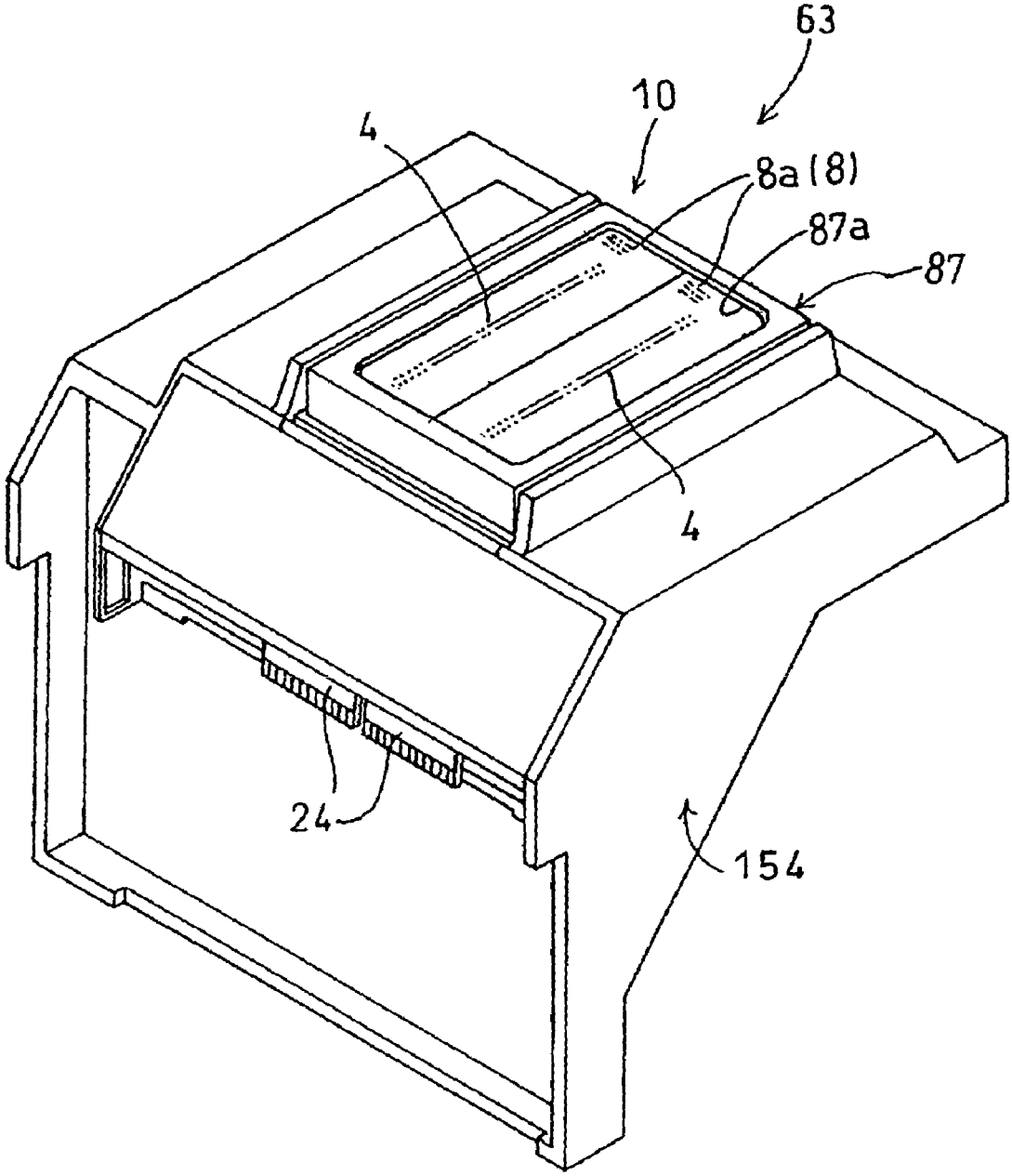
FIG. 9 is a perspective view illustrating a head holder as viewed from the bottom surface side of a head unit.

As shown in FIG. 9, the head unit 63 includes two recording heads 10 and 10 provided parallel to each other on a lower surface side (an upper side in FIG. 9) of a bottom plate 154*a* of the head holder 154; and a protecting cover 87 covering the recording heads 10 and 10. The protecting cover 87 has a box shape and defines an opening window 87*a* allowing the rows of the nozzle holes 4 on a surface of each recording head 10 to be exposed. The protecting cover 87 is fixed to front faces of the recording heads 10, 10 and the head holder 154.

Figure 10:
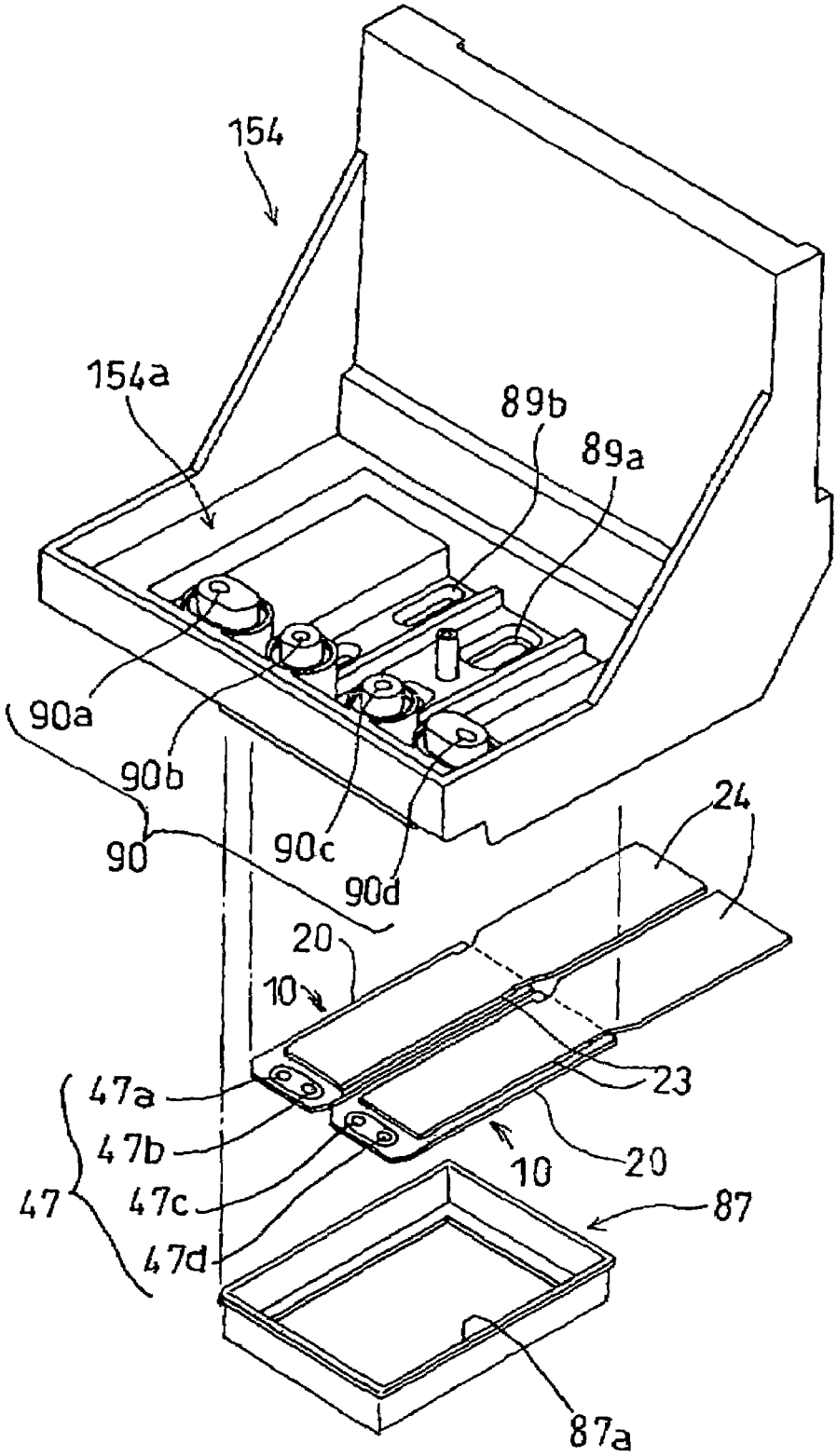
FIG. 10 is an exploded perspective view illustrating a head unit.

As shown in FIG. 10, the head holder 154 has a box shape with its top surface opened. The four ink cartridges 61 serving as the ink supply sources are detachably mounted on opening portions of the head holder 154 from thereabove. The head holder 154 defines in a side portion of a bottom plate 154*a* thereof a supply passage 90 (being designated as 90*a* to 90*d*, respectively), which is capable of connecting to an ink discharge portion (not shown) of each of the ink cartridges 61 (see FIG. 10). Further, holes 89*a* and 89*b* are defined through the bottom plate 154*a* to serve as holes used for injecting an adhesive agent to fix the recording head.

Like the recording head according to the first embodiment, the recording head 10 according to the second embodiment is configured so that the cavity unit 20 in which eight plates are laminated on each other, the piezoelectric actuator unit 23, and the flexible flat cable 24 are laminated and fixed. However, unlike the first embodiment, a single recording head 10 has tow rows of nozzle holes 4 and two ink supply ports 47 so that two color inks are ejected separately. Therefore, the two recording heads 10, 10 are mounted on one head holder 154 to correspond to the four color inks. The total of four ink supply ports 47 (47*a* to 47*d*) are respectively connected to the supply passages 90*a* to 90*d* of the head holder 154, respectively so that the ink is supplied from the ink cartridge 61 to the nozzle holes 4.

As shown in FIG. 9, in the recording head 10 according to the second embodiment, the information recording portion 8 is disposed to be readable from the outside on the nozzle plate 11 side. Like the first embodiment, the information recording portion 8 is inscribed on a surface of the spacer plate 12, which faces the nozzle plate 11, and is covered with the nozzle plate 11 made of a substantially transparent material (the nozzle plate 11 and the spacer plate 12 are not shown in FIGS. 8 to 10). Also, in order to secure a predetermined area for recording information, the information recording portion 8 is disposed outside a region corresponding to the rows of the plural communicating holes 37 in the spacer plate 12 and is disposed at a position corresponding to a connection position between the ink supply ports 47 and the supply passage 90. In other words, the information recording portion 8 at least partially overlaps the connection position when viewed in a plan view.

In addition, in the second embodiment, while only the first code portion 8*a* is illustrated as the information recording portion 8, the second code portion 8*b* may be provided together with the first code portion 8*a*.

Even in configuration in which a plurality of recording heads 10 are mounted on a single inkjet printer as described in the second embodiment, the recording heads 10 are individually managed based on the unique information recorded on the information recording portions 8, and various measured values or data stored from an early stage of the manufacturing process can be always referred to as with the first embodiment. All of the other advantages are the same as those in the first embodiment.

In addition, while the information recording portion 8 is formed as the minute concavity and convexity in the above-mentioned first and second embodiments, the information recording portion 8 may be provided in the form of an IC chip storing unique information, or a small-sized sticker in which the unique information is printed so long as those IC chip and sticker are readable from outside.

Also, while the information recording portion 8 has been provided in the spacer plate 12 (the second plate from the plate defining the nozzle holes 4) adjacent to the nozzle plate 11, the invention is not limited thereto. The information recording portion 8 may be disposed on another plate so long as the information recording portion 8 is readable from outside of the surface from which the nozzle holes 4 are exposed.

The information recording portion 8 may be disposed on the surface of the nozzle plate 11, which is exposed to the outside. If the information recording portion 8 were made of a sticker, it would be impossible to wipe ink soaking into the sticker even with using a wiper member. In the embodiments, the information recording portion 8 is formed as minute concavity and convexity by etching or the like. Therefore, even when the ink contaminates the information recording portion 8 disposed on the exposed surface of the nozzle plate 11, it is possible to remove (wipe) the ink adhered to the information recording portion 8, for example, by using the wiping member. In this case, the nozzle plate 11 is made of a substantially opaque material such as metal or silicon, instead of the substantially transparent material.

In addition, while the recording head 10 has been manufactured by separately forming the first subunit 21 and the second subunit 22, combining the first and second subunit 21 and 22 together to form the cavity unit 20, and further bonding the piezoelectric actuator unit 23 with the cavity unit 20, the recording head 10 may be manufactured using a different combination and sequence in bonding.

What is claimed is:

1. An inkjet recording head comprising:

a plurality of plates bonded to each other, the plates including a first plate defining in one surface thereof a plurality of nozzle holes through which ink is ejected to a recording medium, the one surface of the first plate exposed to an outside; and an information recording portion in which unique information of the inkjet recording head is recorded, the information recording portion disposed so as to be readable from the outside on a one-surface side;

wherein the first plate is substantially transparent;

wherein the plurality of plates further include an opaque second plate defining a plurality of communication holes communicating with the nozzle holes;

wherein the information recording portion is disposed on the second plate; and wherein the first plate is laminated on the second plate to cover the information recording portion.

2. The inkjet recording head according to claim 1, wherein concavity and convexity are formed as the unique information in the information recording portion disposed on the second plate.

3. The inkjet recording head according to claim 1, wherein the information recording portion is disposed outside a region where the communication holes form rows.

4. The inkjet recording head according to claim 1, wherein:

the first plate is made of a synthetic resin; and the second plate is made of one of silicon and metal.

5. The inkjet recording head according to claim 1, wherein the information recording portion includes at least one of serial number, bar code, two-dimensional code, and hologram.

6. An inkjet recording head comprising:

a plurality of plates bonded to each other, the plates including a first plate defining in one surface thereof a plurality of nozzle holes through which ink is ejected to a recording medium, the one surface of the first plate exposed to an outside; and an information recording portion in which unique information of the inkjet recording head is recorded, the information recording portion disposed so as to be readable from the outside on a one-surface side;

wherein the first plate is substantially opaque; and wherein the information recording portion is disposed on the one surface of the first plate; and wherein concavity and convexity are formed as the unique information in the information recording portion disposed on the first plate.

7. The inkjet recording head according to claim 6, wherein the information recording portion is disposed outside a region where the nozzle holes form rows.

8. The inkjet recording head according to claim 6, wherein the information recording portion includes at least one of serial number, bar code, two-dimensional code, and hologram.

9. An inkjet recording head comprising:

a plurality of plates bonded to each other, the plates including a first plate defining in one surface thereof a plurality of nozzle holes through which ink is ejected to a recording medium, the one surface of the first plate exposed to an outside; and an information recording portion in which unique information of the inkjet recording head is recorded, the information recording portion disposed so as to be readable from the outside on a one-surface side;

wherein the one surface of the first plate is identical with one surface of the inkjet recording head, which is exposed to the outside;

wherein the other surface of the inkjet recording head defines therein an ink supply port through which the ink supplied to the nozzle holes are flown from an ink supply source; and wherein the information recording portion is disposed at a position corresponding to a position of the ink supply port.

10. The inkjet recording head according to claim 9, wherein when viewed in a plan view, the information recording portion at least partially overlaps the ink supply port.

11. The inkjet recording head according to claim 9, further comprising:

an ink supply channel extending from the ink supply port along a direction of a row formed of the nozzle holes, wherein:

the ink supply port is disposed outside a region corresponding to the row formed of the nozzle holes.

12. The inkjet recording head according to claim 9, wherein the information recording portion includes at least one of serial number, bar code, two-dimensional code, and hologram.

13. A head unit comprising:

an inkjet recording head including a plurality of plates bonded to each other, the plates including a first plate defining in one surface thereof a plurality of nozzle holes through which ink is ejected to a recording medium, the one surface of the first plate exposed to an outside; and a head holder onto which the inkjet recording head is mounted so that the one surface of the first plate faces the recording medium, the head holder capable of moving in parallel to the recording medium;

wherein the inkjet recording head includes an information recording portion in which unique information of the inkjet recording head is recorded, the information recording portion disposed so as to be readable from the outside on a one-surface side;

wherein the first plate is substantially transparent;

wherein the plurality of plates further include an opaque second plate defining a plurality of communication holes communicating with the nozzle holes;

wherein the information recording portion is disposed on the second plate; and wherein the first plate is laminated on the second plate to cover the information recording portion.

14. The head unit according to claim 13, wherein concavity and convexity are formed as the unique information in the information recording portion disposed on the second plate.

15. A head unit comprising:

an inkjet recording head including a plurality of plates bonded to each other, the plates including a first plate defining in one surface thereof a plurality of nozzle holes through which ink is ejected to a recording medium, the one surface of the first plate exposed to an outside; and a head holder onto which the inkjet recording head is mounted so that the one surface of the first plate faces the recording medium, the head holder capable of moving in parallel to the recording medium;

wherein the inkjet recording head includes an information recording portion in which unique information of the inkjet recording head is recorded, the information recording portion disposed so as to be readable from the outside on a one-surface side;

wherein the first plate is substantially opaque;

wherein the information recording portion is disposed on the one surface of the first plate; and wherein concavity and convexity are formed as the unique information in the information recording portion disposed on the second plate.

16. A head unit comprising:

an inkjet recording head including a plurality of plates bonded to each other, the plates including a first plate defining in one surface thereof a plurality of nozzle holes through which ink is ejected to a recording medium, the one surface of the first plate exposed to an outside; and a head holder onto which the inkjet recording head is mounted so that the one surface of the first plate faces the recording medium, the head holder capable of moving in parallel to the recording medium;

wherein the inkjet recording head includes an information recording portion in which unique information of the inkjet recording head is recorded, the information recording portion disposed so as to be readable from the outside on a one-surface side;

wherein the head holder comprises an ink supply path that introduces the ink to be supplied to the nozzle holes, from an ink supply source to the inkjet recording head;

wherein a connection portion between the ink supply path and the inkjet recording head is disposed outside a region corresponding to a row formed of the nozzle holes; and wherein the information recording portion is disposed at a position corresponding to the connection portion.

17. The head unit according to claim 16, when viewed in a plan view, the information recording portion at least partially overlaps the connection position.

* * * * *